United States Patent [19]

Vogelgesang

[11] 4,381,491

[45] Apr. 26, 1983

[54] DEVICE TO SLOW SOLENOID ACTUATION MOTION

[75] Inventor: Peter J. Vogelgesang, St. Paul, Minn.

[73] Assignee: Minnesota Mining and Manufacturing Company, Saint Paul, Minn.

[21] Appl. No.: 236,260

[22] Filed: Feb. 20, 1981

[51] Int. Cl.[3] ..... H01F 7/08

[52] U.S. Cl. ..... 335/257; 335/247; 335/271; 335/277

[58] Field of Search ..... 335/257, 277, 271, 193, 335/247, 104; 248/358

[56] References Cited

U.S. PATENT DOCUMENTS 2,756,016 7/1956 Painter ..... 248/358
3,226,605 12/1965 Wright et al. ..... 335/257
3,675,172 7/1972 Petusry ..... 335/257

*Primary Examiner*—Harold Broome
*Attorney, Agent, or Firm*—Cruzan Alexander; Donald M. Sell; William D. Bauer

[57] ABSTRACT

A device for slowing down the movement of the armature within a solenoid comprising a resilient container having a predetermined internal volume, and a dilatant material filling the container which material has as one of its properties at ambient temperatures, a non-resilient deformation when subjected to slow steady state stress, and a highly resilient resistance to deformation when subjected to rapid shock-like stress, whereby the container is connected to the solenoid in a manner affording its compression as the armature moves within the solenoid.

6 Claims, 3 Drawing Figures

DEVICE TO SLOW SOLENOID ACTUATION MOTION

TECHNICAL FIELD

This invention relates to devices for reducing the speed of the armature movement within solenoids during their operation.

BACKGROUND OF THE INVENTION

Generally, a solenoid consists of an iron housing enclosing a coil and an armature which is movable within the coil between an extended position where the armature extends from one end of the coil and a retracted position where the armature is within the coil. When an electrical current flows through the coil, a magnetic filed is established which is used to draw the armature inside of the coil until it makes contact with an end of the housing. The force exerted on the armature due to the magnetic field, and in turn, the force which the solenoid is capable of exerting is related to the position of the armature within the coil. As the armature moves into the coil, it replaces what would otherwise be an air gap, and thereby tends to concentrate the lines of magnetic flux forming the magnetic field. This is due to a change in the permeance (i.e. the ease with which the magnetic flux passes) within the magnetic circuit existing within the solenoid. This change in the permeance causes an exponential increase in the force exerted on the armature as it is drawn into the coil. Since the armature weighs only a few ounces, it is rapidly accelerated by this exponentially increasing force and can reach a very high velocity. The high velocity which is reached causes the armature to impart a considerable mechanical vibration within the solenoid as the armature reaches the end of its stroke and contacts the end of the housing. This vibration results in the production of a noise, which in sound reproducing mechanisms such as tape recorders, is very undesirable.

Devices have been used to limit the maximum velocity reached by the armature, and accordingly the amount of vibration produced. One such device is a spring placed in opposition to the movement of the armature, which is compressed by movement of the armature when the solenoid is activated. This spring exerts a counter force on the armature which is generally proportional to the amount of compression. Once compressed, the spring force does not disappear, however and current must continue to flow through the coil of the solenoid, or the armature will be returned to its extended position by the spring force. This continued current flow produces heat which must be dissipated or the solenoid might over heat. For this reason, solenoids in which a spring is used for limiting the armature velocity typically also include a mechanical latching device which latches the spring in its compressed position in order to eliminate the counter force exerted by the spring after the armature reaches its retracted position. This additional latching device allows the current flow in the solenoid to be reduced without the armature returning to its extended position.

Other solenoids utilize an air or fluid pot as an alternative to a spring, which air or fluid pot is a variable volume cylinder (e.g. a piston within a cylinder) containing air or fluid which is allowed to escape at a controlled rate through an orifice within the cylinder, as the movement of the armature forces the piston to move into the cylinder. The counter force exerted by such an air or fluid pot is determined by the area of the orifice through which the air or fluid is escaping, and the pressure against which the air or fluid must flow. An air or fluid pot is more costly than its mechanical counterparts because of the required close tolerances involved with hydraulic devices, and the need to prevent leakage of air or fluid from the hydraulic system.

SUMMARY OF THE INVENTION

The present invention is directed to a simplified armature speed reduction device for use with a solenoid which exerts a counter force against the solenoid which is proportional to the rate of application of the force being exerted by the solenoid. In other words the counter force of the noise reduction device is proportional to the change in acceleration of the armature within the solenoid with respect to time. This proportional relationship permits the present invention to limit the maximum velocity achieved by the armature within the solenoid in a more efficient manner without sacrificing the desired rapid operation of the solenoid, without converting an undue amount of energy into heat, and at a relatively low cost.

This noise reduction device comprises resilient means for defining a container having a predetermined internal volume, and a dilatant material filling the container, which material has as one of its properties at ambient temperatures, a non-resilient deformation when subjected to slow steady state stress, but a highly resilient resistence to deformation when subjected to rapid shock-like stresses. The container, filled with the dilatant material, is fastened at one end of the solenoid so that it will be contacted and compressed by the armature or an extension thereof during the movement of the armature from its extended position to its retracted position. Because of the dilatant properties of the material contained within the resilient container, the noise reduction device is able to resist the rapid changes in acceleration of the armature while continuing to slowly deform in response to the steady force applied on the armature. Once the container and the dilatant material contained therein have been deformed, the only force tending to return the container and the material therein to their original shape is the resilience of the container itself. This force is typically of a very low magnitude compared to the force which the armature of the solenoid can exert when it is in its retracted position. Thus, once the noise reduction device has been deformed, the current flow within the coil of the solenoid can be diminished while the solenoid remains actuated.

BRIEF DESCRIPTION OF THE DRAWING

The present invention will be further described hereinafter with reference to the accompanying drawing wherein.

DETAILED DESCRIPTION

Figure 1:
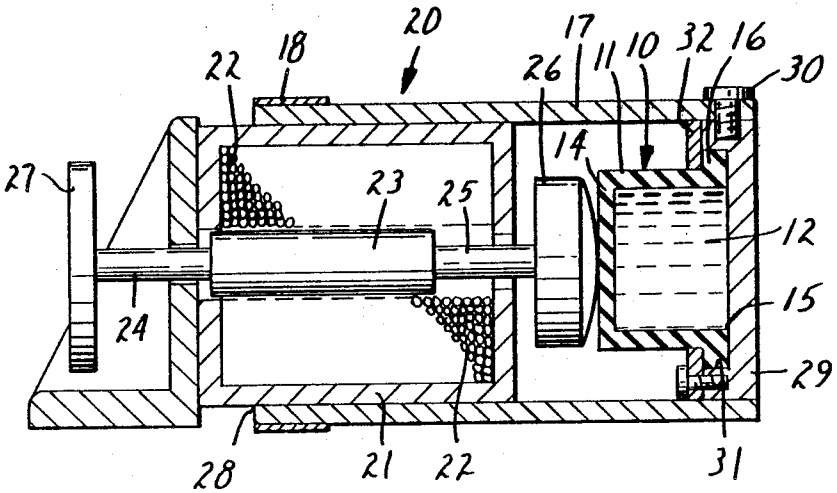
FIG. 1 is a longitudinal section of the noise reduction device according to the present invention, attached to a solenoid.

A solenoid noise reduction device 10 according to the present invention and a solenoid 20 on which it is mounted are illustrated in FIG. 1. The solenoid 20 has an iron housing 21 enclosing a coil 22 and an armature 23 which is movable with respect to the coil 22 between an extended position at which a large portion of the armature 23 projects from within the coil 22, and a retracted position at which the armature 23 is positioned substantially within the coil 22. A first shaft 24 is connected at one end to the armature 23 and passes through one end of the housing 21 where it can be connected to some external assembly 27 which is to be moved via movement of the armature 23. A second shaft 25 is connected at the end of the armature 23 opposite the shaft 24, and passes through the opposing end of the housing 21 at its end opposite the armature 23. This second shaft 25 supports a plunger 26. The solenoid 20 thus far described is typical of those commercially available. The noise reduction device 10 according to the present invention is positioned adjacent the plunger 26 and disposed in the path of the plunger 26 as the solenoid 20 is actuated to move the armature 23 from its extended to its retracted position.

The noise reduction device 10 comprises resilient means for defining a container 11 having a predetermined internal volume, and a dilatant material 12 filling the container 11. By dilatant material 12 we mean a material which has as one of its properties at ambient temperatures, a non-resilient deformation when subjected to slow, steady-state stress, and a highly resilient resistance to deformation when subjected to rapid shock-like stresses. Materials having this property at ambient room temperatures are unique in that their rheologic flow curves (i.e. shear stress versus shear rate), indicate the absence of a pseudoplastic transition region between the rheologic state where the material behaves in a Newtonian fashion, and the state where the property of dilatant is normally observed. In the preferred embodiment the dilatant material 12 which is utilized is a polydimethyl silicone rubber which has been reacted with a compound containing boron in order to achieve the occurrence of borosilicate bonding. This material is commonly and commercially known as bouncing putty or silly putty, and is described in U.S. Pat. No. 2,541,851. Alternatively, however, the same behavior might be achieved by utilizing a low molecular weight polymer having a glass transition temperature ($T_g$) below $-50$ degrees centigrade, which is cross-linked with a material or process which does not add sufficient polar components to shift the $T_g$ toward $-10°$ C. The amount of cross-linking must be sufficient to provide a soft, but still dilatant stress versus rate of strain curve at ambient temperatures, and under stress rates which are typical of those obtained during solenoid closings. The cross-linking should not, however, add sufficient polar components to make the material too rigid. Examples of such alternate materials are the silicon gel used in breast implants (i.e., a vinyl terminated polydimethylsiloxane, with a degree of polymerization of between 1000 and 10,000, which is cured by means of a platinum complex having a hydrogen functional polydimethylsiloxane molecule lower molecular weight hydrocarbon polymers; such as predominantly cis 1–4 polybutadiene or cis 1–4 polyisoprene as are prepared by polymerization of anionic means using either butyl lithium or the organoaluminum compound-transition metal halide (Ziegler-Natta) catalysts, the lower molecular weight polyisobutylene (Vistanex) or polyisobutene-co-isoprene (Butyl rubber) prepared by cationic (Friedal-Crafts) catalysts of which $AlCl_3$ is the principal material used, and the lower molecular weight polymers of poly-isooctyl acrylate or poly-2-ethyl hexyl acrylate polymerized using free radical initiators, preferably in solution to achieve the lower molecular weights. The lower molecular weight hydrocarbon polymers may be crosslinked by a number of materials and thermal or irradiative processes to provide the desired soft yet dilatent stress versus rate of strain response at ambient temperatures. Preferred are the peroxides, especially di alkyl and teriary alkoxyl types. Particularly useful are dibenzoyl peroxide, dicumyl peroxide, 2,5-dimethyl-2,5-dit(t butyl peroxy) hexane or hex-3-yne, and di(2-t butyl peroxy) diisopropyl benzene. The molecular weight of the polymer must be chosen to adjust for the chain scission which occurs along with the crosslinking reaction with peroxides. Chain scission will show the greatest effect in the polyisobutylene and polyisobutene-co-isoprene polymers. Cis 1-4 polybutadiene, cis 1-4 polyisoprene prepared by polymerization with a butyl lithium catalyst and lower molecular weight butyl rubber or poly Iso butylene.

The elastic container 11 for the dilatant material 12 is molded from an elastomeric material such as a black natural rubber having a hardness of 35 to 45 durometer A, as available from the Robinson Rubber Co. of New Hope, MN under their compound designation 14240. This container 11 includes wall members defining a cylindrical tube having a first end 14 which is closed and a second end 15 with an opening therethrough. The elastic container 11 further includes a flange 16 extending radially outward from its second end 15. This flange 16 is utilized to attach the device 10 to the solenoid 20. For this purpose a cylindrical connecting frame 17 mates with, and is clamped onto the solenoid housing 21 by a hose clamp 18. One end 28 of the connecting frame 17 is open to allow passage of the solenoid 20, and the other end is closed by an end piece 29 which is fastened to the frame 17 by screws 30. The end piece 29 contains a depression 31 adapted to receive the second end 15 of the elastic container 11. A washer 32 is placed over the tube and fastened to the end piece 29, thus securing the flange 16 within the depression 31.

Figure 2:
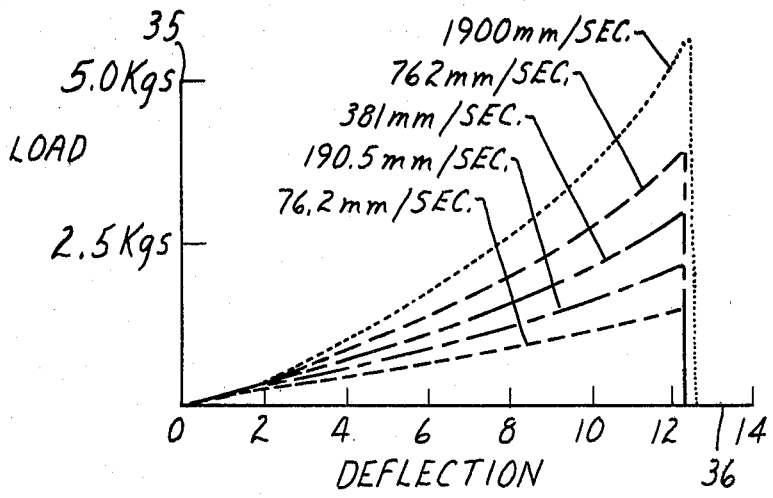
FIG. 2 is a graph of the stress versus strain curve for the present invention at a variety of stress rates.
Figure 3:
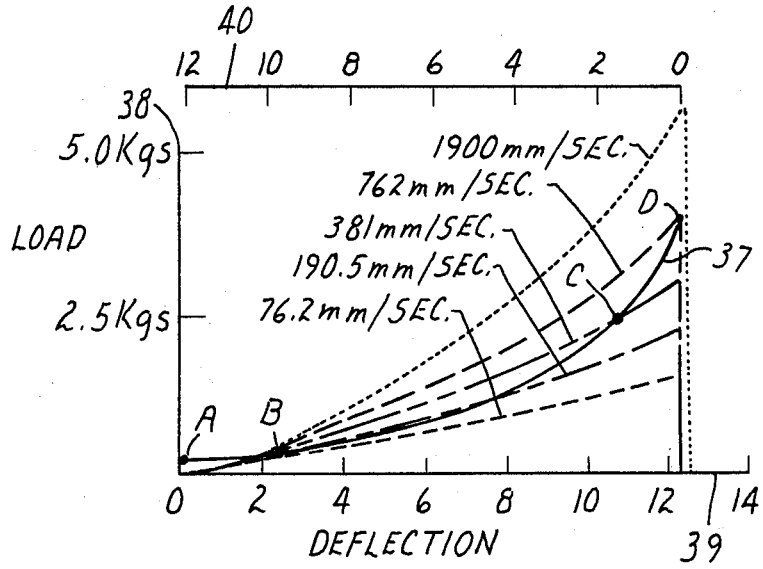
FIG. 3 is the graph of FIG. 2 with a typical force versus stroke curve for a solenoid superimposed thereon.

For a better understanding of the operation of the present invention, reference should be made to FIG. 2 wherein is shown a graph of various stress versus strain curves for the noise reduction device 10 as they occur for various stress rates typical of solenoid closing rates. The vertical axis 35 of the graph indicates the load which is applied on the device 10 in kilograms and the horizontal axis 36 indicates the resultant deformation or compression of the device 10 in millimeters. As can be seen, each of the curves for the various stress rates, exhibits a generally exponential relationship until a region is reached where the material breaks down. The advantage of this exponential relationship is more clearly understood by reference to FIG. 3 wherein a typical force versus stroke curve 37 for a solenoid has been superimposed upon the stress versus strain curves of FIG. 2. The vertical axis 38 now also indicates the load or force which the solenoid 20 exerts, the bottom horizontal axis 39 remains the same, and a new upper axis 40 indicates the distance in millimeters of the armature away from complete closure within the solenoid 20. As can be seen from FIG. 3, the solenoid 20 first contacts the device 10 according to the present invention (Point "A") when there is approximately 12.7 millimeters (½ inch) remaining in the stroke of the solenoid 20. At this position of the armature 23, the solenoid 20 is capable of exerting a force of approximately 0.43 kilogram (15 ounces). Since the solenoid 20 first contacts the noise reduction device 10 in a rapid shock-like manner, there is initially a highly resilient resistance to any deformation of the device 10. The force applied by the solenoid 20 however continues and the noise reduction device 10 begins to deform in response to its steady state force. The speed of the deformation, however, is at some rate which is less than 190.5 millimeters per second (7.5 inches per second). The first intersection (Point "B") with the slowest rate curve of the graph appears at an armature position of 9.53 millimeters (⅜ inch). At this position, the solenoid is exerting a force of approximately 0.65 kilogram (23 ounces). At this load or force the rate of deflection of the noise reduction device 10 is approximately 190.5 millimeters per second (7½ inches per second). The stead state force exerted by the solenoid 20 continues to increase thus tending to increase the rate of deflection of the noise reduction device 10. At an armature position (Point "C") of approximately 1.5 millimeters (1/16 of an inch), the operating curve of the solenoid 20 intersects with the rate curve of the noise reduction device 10 corresponding to 38.1 centimeters per second (15 inches per second). Thus, when the solenoid is exerting 2.36 kilograms (133 ounces), the rate of deflection has increased to approximately twice the original rate. Finally, as the solenoid 20 approaches the end of its stroke (Point "D"), and is exerting approximately 4½ kilograms (10 pounds), the rate of deflection of the noise reduction device 10 again doubles in speed and reaches a maximum velocity of approximately 760.2 millimeters per second (30 inches per second). Thus between the first measured value of 190.5 millimeters per second (7½ inches per second) and the final value of 762 millimeters per second (30 inches per second) there is only a fourfold increase in the velocity of the solenoid 20 over the length of its stroke. This increase is substantially less than what would occur for a solenoid 20 operating without such a noise reduction device 10.

During the operation of the noise reduction device 10 according to the present invention, the magnetic force of the solenoid 20 compresses or makes oblate the cylindrical portion of the container 11 and displaces or deforms the dilatent material 12 contained therein. As this deformation occurs, the device 10 offers resistance to any increase in the solenoids acceleration. Once the deformation has occured, however, there is very little residual force remaining in the device 10 which would tend to bias the armature 23 back to its extended position. This is due to the lack of resilience in the dilatent material 12. In fact, the only residual force remaining in the device 10 is due to the resilience of the container 11. This force is quite small relative to the force that can be applied by the solenoid 20 when its armature 23 is in its retracted position. Thus, the current flow needed in solenoid 20 to maintain the armature 23 at its retracted position is only a fraction of what was required to originally move the armature to its retracted position. This substantially minimizes the amount of energy converted to heat within the solenoid 20.

Having described a preferred embodiment of the present invention, it will be understood that changes may be made in the size, shape, or configuration of some of the parts described herein without departing from the present invention as recited in the appended claims.

What is claimed is:

1. A noise reduction device for use with a solenoid having a movable armature therein, said device comprising resilient means for defining a container having a predetermined internal volume, a dilatant material filling said container, which material has as one of its properties at ambient temperatures, a non-resilient deformation when subjected to slow steady state stress, and a highly resilient resistance to deformation when subjected to a rapid shock-like stress, and means for mounting said device in the path of the armature and in opposition to the movement of the armature, to afford a resistance to rapid changes in the acceleration of the armature while slowly deforming in response to the force applied by the armature.

2. A device as claimed in claim 1 wherein said dilatent material is selected from a group consisting of polydimethylsilicone rubbers having borosiloxane bonds.

3. A device as claimed in claim 1 wherein said container is molded from an elastomeric material and includes wall members defining a cylindrical tube having a first end which is closed, and a second end with an opening therethrough.

4. A device as claimed in claim 1 wherein said means for mounting said device in opposition to the movement of the armature within the solenoid comprises a flange extending radially outward from said container.

5. A solenoid which operates with comparatively little noise comprising a housing, a coil mounted with said housing and connectable to an electricity source to generate a magnetic field within said housing, an armature mounted within said housing and movable with respect to said coil between an extended position at which a large portion of said armature projects from said coil, and a retracted position at which the armature is substantially within the coil, a plunger supported on one end of said armature, resilient means for defining a container having a predetermined internal volume, a dilatant material filling said container, which material has as one of its properties at ambient temperatures, a non-resilient deformation when subjected to slow steady state stress, and a highly resilient resistance to deformation when subjected to a rapid shock-like stress, and frame means for connecting said container to said housing such that said container will be contacted and compressed by said plunger as said armature moves from said extended position to said retracted position, whereby rapid changes in the acceleration of said plunger will be resisted by said dilatant material and said resilient means as said dilatant material and said resilient means slowly deform in response to the force applied by said plunger.

6. In a sound reproducing mechanism including a solenoid having a housing, a coil, an armature mounted within the coil and movable between an extended position at which a large portion of the armature projects from the coil and a retracted position at which the armature is substantially within the coil, and a plunger supported on one end of the armature, the improvement comprising a noise reduction device for the solenoid having resilient means for defining a container having a predetermined internal volume, and a dilatant material filling said container, which material has as one of its properties at ambient temperatures, a non-resilient deformation when subjected to slow steady state stress, and a highly resilient resistance to deformation when subjected to a rapid shock-like stress, and frame means for connecting said container to said housing such that said container will be contacted and compressed by the plunger during the movement of the armature from its extended position to its retracted position, whereby rapid changes in the acceleration of said plunger will be resisted by said dilatant material and said resilient means as said dilatant material and said resilient means slowly deform in response to the force applied by said plunger.

* * * * *

UNITED STATES PATENT AND TRADEMARK OFFICE

CERTIFICATE OF CORRECTION

PATENT NO. : 4,381,491

DATED : April 26, 1983

INVENTOR(S) : Peter J. Vogelgesang

It is certified that error appears in the above—identified patent and that said Letters Patent is hereby corrected as shown below:

Abstract, line 1, delete "down".

Col. 1, line 17, change "filed" to -- field --.

Col. 4, line 10, change "teriary" to -- tertiary --.

Signed and Sealed this

*Twelfth* Day of *July 1983*

[SEAL]

*Attest:*

*Attesting Officer*

GERALD J. MOSSINGHOFF

*Commissioner of Patents and Trademarks*